US005450789A

United States Patent [19]

Hasegawa

[11] Patent Number: 5,450,789

[45] Date of Patent: Sep. 19, 1995

[54] STENCIL PRINTING METHOD

[75] Inventor: Takanori Hasegawa, Tokyo, Japan

[73] Assignee: Riso Kagaku Corporation, Tokyo, Japan

[21] Appl. No.: 47,521

[22] Filed: Apr. 19, 1993

[30] Foreign Application Priority Data

Apr. 20, 1992 [JP] Japan ..... 4-099627

[51] Int. Cl.[6] ..... B41M 1/12; B41C 1/14

[52] U.S. Cl. ..... 101/129; 101/128.21; 101/128.4; 427/259

[58] Field of Search ..... 101/115, 127.1, 128.4, 101/128.21, 129, DIG. 36, 401.1; 427/259, 282

[56] References Cited

U.S. PATENT DOCUMENTS

| | | | |
|---|---|---|---|
| 1,706,038 | 3/1929 | Owens | 101/128.4 |
| 2,153,435 | 4/1939 | Schneider et al. | 101/115 |
| 2,613,595 | 10/1952 | Weldon | 101/115 |
| 3,735,699 | 5/1973 | Koelschbach | 101/115 X |
| 4,348,953 | 9/1982 | Cole et al. | 101/128.21 |
| 4,497,848 | 2/1985 | Baran | 101/128.4 X |
| 4,813,351 | 3/1989 | Pierson, Jr. | 101/115 |
| 5,251,567 | 10/1993 | Fuwa | 101/128.4 |

FOREIGN PATENT DOCUMENTS

| | | | |
|---|---|---|---|
| 3-270974 | 12/1991 | Japan . | |
| 0393218 | 6/1933 | United Kingdom | 101/115 |
| 1293007 | 10/1972 | United Kingdom | 101/115 |

*Primary Examiner*—Chris A. Bennett
*Attorney, Agent, or Firm*—Dickstein, Shapiro & Morin

[57] ABSTRACT

To allow a highly accurate superimposition printing to be accomplished in a simple manner without requiring any complicated positioning work, a plurality of stencil master plates A, B and C are formed in different parts of a single stencil master plate sheet S with a pre-defined positional relationship, and the printed images by the different stencil master plates A, B and C formed on the common stencil master plate sheet S are superimposed on a same region of printing paper P by causing a relative displacement between the stencil master plate sheet S and the printing paper P. The present invention is particularly suitable for achieving a color printing by superimposing stencil prints made by ink of different colors.

4 Claims, 11 Drawing Sheets

STENCIL PRINTING METHOD

TECHNICAL FIELD

The present invention relates to a stencil printing method and a master plate making printing device, and in particular to a stencil printing method and a master plate making printing device suitable for making mutually superimposed prints.

BACKGROUND OF THE INVENTION

In multicolor printing processes such as full-color printing processes, a plurality of master plates are prepared for different colors such as cyan, magenta and yellow through the process of color separation, and a printing process is repeated for each of the master plates or, in other words, the prints by the different master plates are superimposed one over another.

When a multicolor printing process is to be carried out according to the principle of superimposition, the master plate for each of the colors is prepared, and the printing process is repeated by mounting each of the master plates in turn, so that the master plate is required to be changed each time the printing process with one of the master plates it completed.

According to such a printing process based on the principle of superimposition, each print must be made on an identical region of the print object such as printing paper. Otherwise, misregistration occurs, and the print result will become unsatisfactory.

To ensure that each print is made on an identical region of the print object such as printing paper, not only a high level of accuracy must be achieved with regard to the positioning of the print object such as printing paper relative to each of the stencil master plates used for the stencil printing or, in other words, the accuracy of the registration of the print object relative to the stencil printing device must be raised to a high level, but also each stencil master plate must be accurately mounted on the master plate mounting unit of the stencil printing device.

However, such a positioning process cannot be easily achieved in the cases of simple stencil printing devices of the printing press type for home and offices use, and the registration accuracy is further compounded by the error in the mounting position of the stencil master plate. Therefore, according to such stencil printing devices, it is extremely difficult to achieve good results by using the printing process based on the principle of superimposition.

BRIEF SUMMARY OF THE INVENTION

In view of such problems of the prior art, a primary object of the present invention is to provide a stencil printing method which allows superimposition printing to be carried out both easily and accurately without requiring a complicated mounting process, and a stencil plate making printing device suitable for carrying out this stencil printing method.

A second object of the present invention is to provide stencil printing method which allows color printing to be carried out easily and in a highly aesthetically acceptable manner without requiring a complicated mounting process, and a stencil plate making printing device suitable for carrying out this stencil printing method.

These and other objects of the present invention can be accomplished by providing a stencil printing method, comprising the steps of: making a plurality of stencil master plates in different regions of a stencil master plate sheet in a pre-defined mutual positional relationship; and making prints on a same region of a print object by using the stencil master plates in a mutually superimposed relationship.

Preferably, the stencil master plate sheet is moved in a first direction as it is fed to a printing position, and the stencil master plates are arranged in a single row in the stencil master plate sheet, the row extending in a second direction substantially perpendicular to the first direction. To the end of simplifying the process of causing relative movement between the stencil master plate sheet and the print object for satisfactory superimposition printing to be effected, the prints may be made on the same region of the print object in a mutually superimposed relationship by moving the print object while keeping the stencil master plate sheet stationary.

Alternatively, the stencil master plate sheet may be moved in a first direction as it is fed to a printing position while the stencil master plates are arranged in a single row in the stencil master plate sheet, the row extending substantially in parallel with the first direction. In this case, the prints may be made on the same region of the print object in a mutually superimposed relationship by moving the print object while keeping the stencil master plate sheet stationary or by moving the stencil master plate sheet while keeping the print object stationary.

If the prints are made on the same region of the print object in a mutually superimposed relationship by using a plurality of inks having different colors, a color printing can be effected.

The above mentioned objects of the present invention can be also accomplished by providing A master plate making printing device, comprising: a stencil master plate holding member; master plate making means for making a plurality of stencil master plates in different locations of a stencil master plate sheet supported by the stencil master plate holding member in a pre-defined mutual positional relationship; displacing means for causing a relative displacement between the stencil master plate sheet and a print object so as to place the print object to positions corresponding to the different stencil master plates formed in the stencil master plate sheet; and stencil printing means for carrying out a process of stencil printing on the print object by using each of the different stencil master plates formed in the stencil master plate sheet.

According to a preferred embodiment of the present invention, the stencil master plate sheet consists of a continuous sheet which is fed in a first direction by first feeding means, and the print object consists of a continuous paper which is fed in a second direction which is substantially perpendicular to the first direction by second feeding means, although the print object may also consist of cut sheet paper.

According to a particularly preferred embodiment of the present invention, the stencil master plates are arranged in the stencil master plate sheet as a row extending in the second direction, and the second feeding means comprises means for moving the printing paper in the second direction by a distance corresponding to a pitch of the stencil master plates in the second direction.

Typically, the stencil printing means comprises a printing ink applicator which is separated into a plurality of regions corresponding to the different locations of the stencil master plates in the stencil master plate sheet.

According to an alternate embodiment, the stencil master plates are arranged in the stencil master plate sheet as a row extending in the first direction, and the first feeding means comprises means for moving the stencil master plate sheet in the first direction by a distance corresponding to a pitch of the stencil master plates in the first direction.

According to another embodiment of the present invention, the stencil printing means comprises a rotatable member having a plurality of faces which can be selectively directed to the stencil master plates, and the regions of the printing ink applicator are provided on corresponding ones of the faces.

The stencil printing of the present invention may be not only the type using normal printing ink but also the type using a powder ink adhering agent in combination with powder ink or the type based on the used of electrographic toner.

According to the basic concept of the present invention, a plurality of stencil plates are formed in different regions of a single stencil master plate sheet in a predefined mutual positional relationship, and the stencil master plate sheet absolutely determines as a carrier of these stencil master plates the mutual positional relationship of the stencil master plates so that even when the stencil master plate sheet is moved from the plate making position to the printing position the mutual positional relationship between the stencil master plates remains fixed. Therefore, when one of the stencil master plates in the stencil master plate sheet is determined at the stencil printing position, the positions of the remaining stencil master plates are automatically determined without any error with the first mentioned stencil master plate serving as a reference, and the accuracy of the superimposition printing is affected only by the accuracy of the position of the print object relative to each of the stencil master plates.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
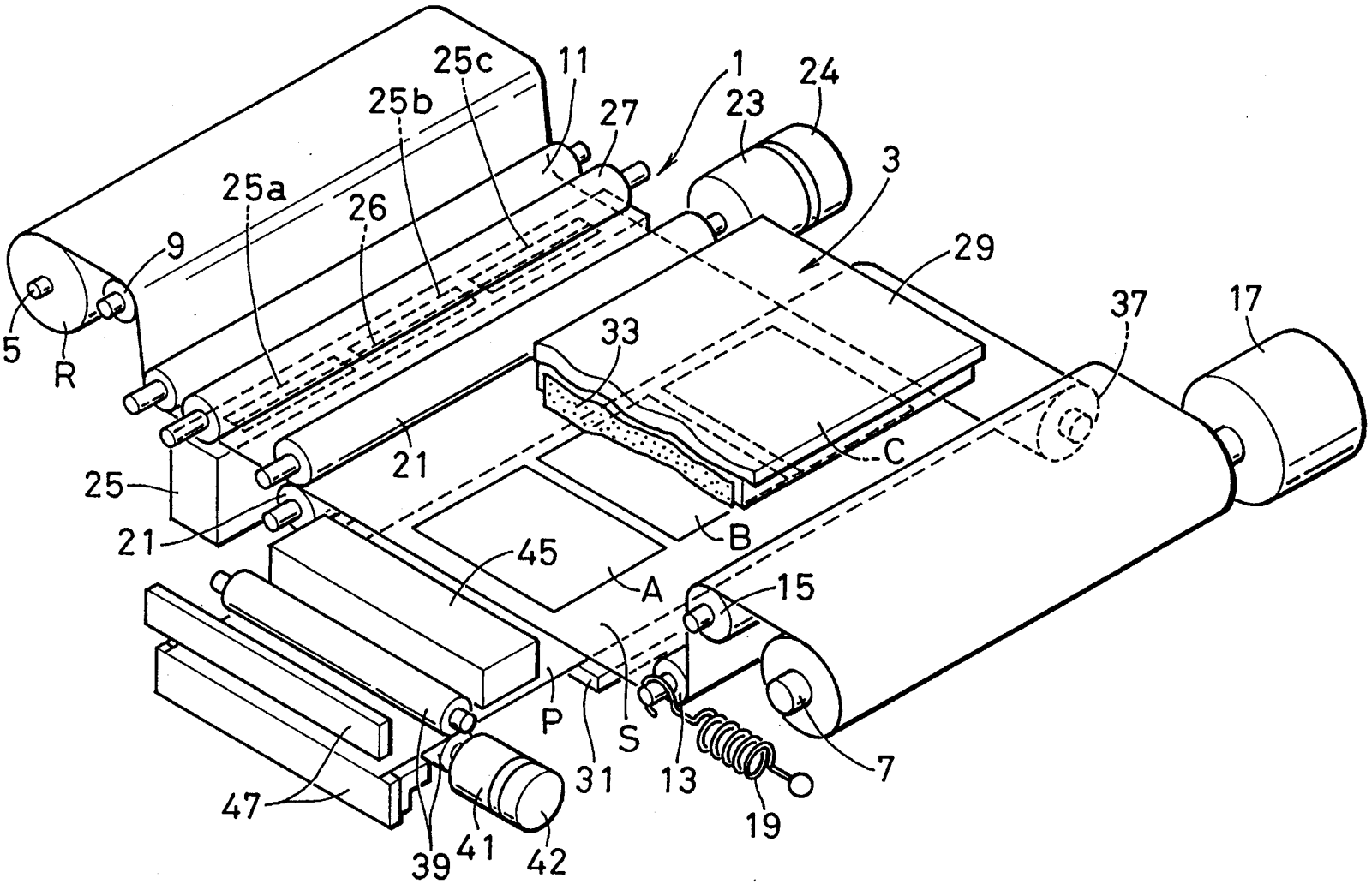
FIG. 1 is a perspective view showing a first embodiment of the plate making printing device according to the present invention.

FIGS. 1 through 4 show an embodiment of the plate making printing device according to the present invention. The plate making printing device comprises a plate making device 1 and a stencil printing device 3. In this plate making printing device, a stencil master plate sheet S consisting of a continuous sheet which can be thermally perforated is wound around a roll shaft 5 as a master plate sheet roll R, and extends across the plate making device 1 and the stencil master plate printing device 3 guided by guide rollers 9, 11, 13 and 15 arranged between the roll shaft 5 and a winding shaft 7 so that a certain length of a horizontal span of the master plate sheet S may extend between the guide rollers 11 and 13.

The stencil master plate sheet S of the thermal perforation type may consist of a laminated assembly of a thermoplastic resin film and a porous support sheet such as Japanese paper or synthetic fiber web, and the stencil images are thermally perforated in the thermoplastic resin film.

The winding shaft 7 is rotatively driven by a motor 17, and winds the stencil master plate sheet S around itself as it is rotatively driven.

The guide roller 13 serves also as a tension roller by being biased by a spring 19 so that a prescribed tension may be applied to the stencil master plate sheet S.

A pair of master plate sheet feed rollers 21 are provided adjacent a path of the stencil master plate sheet S, more specifically adjacent the horizontal path thereof. The master plate sheet feed rollers 21 are rotatively driven by a motor 23 so that the stencil master plate sheet S may be conveyed at a prescribed speed in a secondary scanning direction in synchronism with the plate making operation at the plate making device 1. The motor 23 is provided with a rotary encoder 24 which monitors the rotation of the master plate sheet feed rollers 21 or, in other words, the feed distance of the stencil master plate sheet S in the secondary scanning direction for the feedback control of the motor 23.

The plate making device 1 is provided with a thermal head 25 and a platen roller 27 which extend laterally across the horizontal span of the stencil master plate sheet S or, in other words, extend in the primary scanning direction, interposing the stencil master plate sheet S therebetween from above and below. The thermal head 25 is adapted to make a printing master plate by perforating the stencil master plate sheet S in a dot matrix, and is provided with a plurality of dot-shaped heat generating elements 26 densely arranged in a single row or in two rows in a staggered relationship extending in the primary scanning direction. In this embodiment, the dot-shaped heat generating elements 26 are separated into three different plate making groups as indicated by numerals 25*a*, 25*b* and 25*c* along the primary scanning direction so that these groups 25*a*, 25*b* and 25*c* of heat generating elements may individually make stencil master printing plates in corresponding regions of the stencil master plate sheet S. In this case, the relative positions of the stencil master plates formed in different parts of the stencil master plate sheet S are absolutely determined by the fixed relative physical positioning of the plate making groups 25*a*, 25*b* and 25*c* of the thermal head 25. Thus, the thermal head 25 can make stencil master plates in a plurality of different regions of the stencil master plate sheet S with a prescribed relative positional relationship by means of the plate making groups 25*a*, 25*b* and 25*c*.

The control of the feeding of the stencil master plate sheet S in the secondary scanning direction may also be carried out by way of the control of the rotation of the platen roller 27 instead of the master plate sheet feed rollers 21.

The stencil printing device 3 is disposed adjacent a part of the horizontal path of the stencil master plate sheet S on a side closer to the winding shaft 7 than the plate making device 1, and comprises an ink pad member 29 facing the upper surface of the stencil master plate sheet S from above and a planar press plate member 31 facing the lower surface of the stencil master plate sheet S from below.

The ink pad member 29 is provided with a planar impregnated layer 33 impregnated with printing ink and facing downward. The impregnated layer 33 is separated into three ink impregnated regions 33*a*, 33*b* and 33*c* arranged along the primary scanning direction (refer to FIG. 4) so as to correspond with the plate making groups 25*a*, 25*b* and 25*c* of the thermal head 25, and the ink impregnated regions 33*a*, 33*b* and 33*c* are impregnated with ink of different colors, for instance, yellow printing ink, magenta printing ink, and cyan printing ink, respectively, for full color printing.

Figure 2:
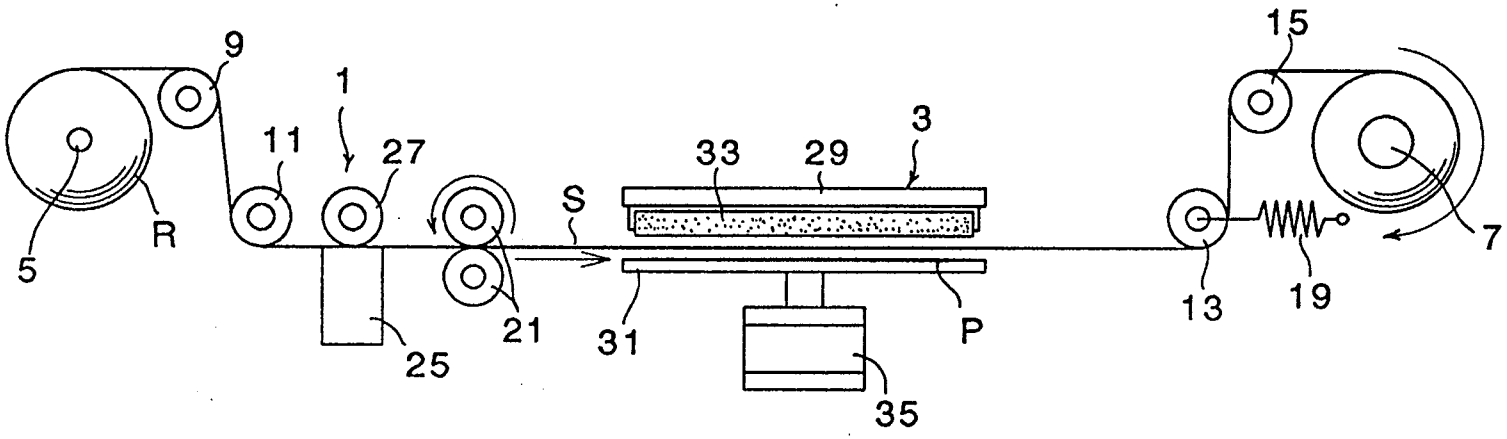
FIG. 2 is a side view showing the first embodiment of the plate making printing device according to the present invention when making a printing plate.
Figure 3:
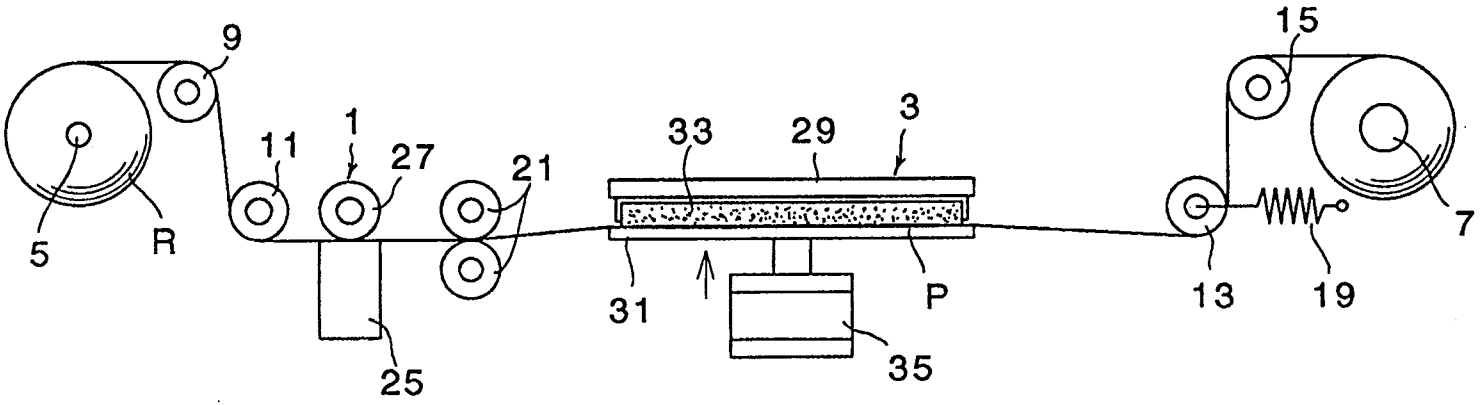
FIG. 3 is a side view showing the first embodiment of the plate making printing device according to the present invention when carrying out a stencil printing.
Figure 4:
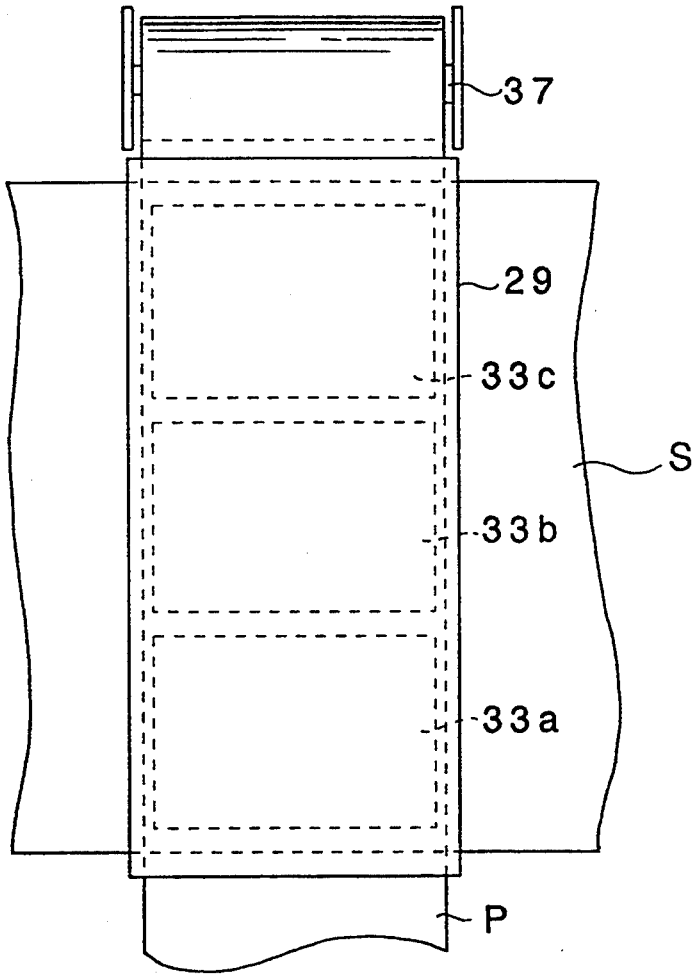
FIG. 4 is a plan view showing the stencil printing unit of the first embodiment of the plate making printing device according to the present invention.

The press plate member 31 is supported by a vertical actuator 35 which may consist of a solenoid or the like in a vertically moveable manner, and can move between a lower position spaced from the lower surface of the stencil master plate sheet S as illustrated in FIG. 2 and an upper position for pressing the stencil master plate sheet S against the ink pad member 29 as illustrated in FIG. 3.

Printing paper P extends above the press plate member 31 in the primary scanning direction or, in other words, laterally across the stencil master plate sheet S. The printing paper P consists of a continuous sheet of paper, and extends horizontally below the stencil master plate sheet S in the primary scanning direction between a roll shaft 37 arranged on one lateral side of the stencil master plate sheet S and a pair of paper feed rollers 39 arranged one above the other on the other lateral side of the stencil master plate sheet S. The paper feed rollers 39 are rotatively driven by a motor 41 so that the printing paper P may be conveyed laterally across the width of the stencil master plate sheet S. The motor 41 is provided with a rotary encoder 42 which monitors the rotation of the paper feed rollers 39 or, in other words, the feeding distance of the printing paper P effected by the paper feed rollers 39.

A heater 45 is placed in a position located above the path of feeding the printing paper P which is closer to the stencil master plate sheet S than the paper feed rollers 39, for drying the printing ink forming the printed image on the printing paper P.

Further, a cutter 47 is provided in the path of feeding the printing paper P for cutting the printing paper P fed out from the paper feed rollers 39.

According to the above described structure, first of all, a plate making signal is supplied to each of the plate making groups 25*a*, 25*b* and 25*c* of the thermal head 25 which make perforations in the stencil master plate sheet S in the manner of a dot matrix with the dot-shaped heat generating elements 26. In synchronism with this perforation process, the master plate sheet feed rollers 21 are rotatively driven by the motor 23 for feeding the stencil master plate sheet S in the secondary scanning direction at a prescribed speed. As a result, stencil master plates A, B and C are formed in three locations on the stencil master plate sheet S arranged in a single row in the primary scanning direction.

The plate making signals supplied to the plate making groups 25*a*, 25*b* and 25*c* of the thermal head 25 may consist of yellow, magenta and cyan printing signals produced from a color separation process for full color printing. In this case, the printing plates for a yellow printing image, a magenta printing image and a cyan printing image may be formed by the plate making groups 25*a*, 25*b* and 25*c*, respectively. Therefore, the stencil master plates A, B and C are adapted for yellow, magenta and cyan printing processes, respectively.

The stencil master plates A, B and C are formed by the plate making groups 25*a*, 25*b* and 25*c*, respectively, and their relative positions along the secondary scanning directions are definitely determined by the fixed physical relative positions of the plate making groups 25*a*, 25*b* and 25*c* of the thermal head 25, or, in other words, are pre-defined by the fixed relative positions of the plate making groups 25*a*, 25*b* and 25*c* of the thermal head 25.

Therefore, once the position of one of the stencil master plates A is determined, the positions of the remaining stencil master plates B and C along the secondary scanning direction are accurately determined with the position of the first stencil master plate A serving as a reference.

While the stencil master plate sheet S is being conveyed by the master plate sheet feed rollers 21, the winding shaft 7 is rotatively driven by the motor 17 for winding the stencil master plate sheet S thereon so that the stencil master plate sheet S may be prevented from slacking.

When a plate making operation is completed, the stencil master plate sheet S is conveyed in the secondary scanning direction by the master plate sheet feed rollers 21 and the winding shaft 7 until the stencil master plates A, B and C reach the stencil printing positions located immediately below the ink pad member 29. The feeding distance of the stencil master plate sheet S in the secondary scanning direction is monitored by the rotary encoder 24 by detecting the rotation of the motor 23, and the positioning of the stencil master plates A, B and C of the stencil master plate sheet S with respect to the stencil printing positions is accurately carried out by feedback control of the rotation of the stencil master plate sheet S based on the amount of rotation of the motor 23 detected by the rotary encoder 24.

When the stencil master plate sheet S is being conveyed, the press plate member 31 is at its lower position, and would not obstruct the conveying of the stencil master plate sheet S.

When the stencil plates A, B and C of the stencil master plate sheet S are finally conveyed to the stencil printing positions, the press plate member 31 is lifted by the vertical actuator 35, and the printing paper P on the press plate member 31 is pushed against the lower surface of the stencil master plate sheet S. As the plate member 31 is further lifted, the upper surfaces of the stencil plates A, B and C of the stencil master plate sheet S are pushed against the ink pad member 29.

Thus, the ink impregnated region 33*a* of the impregnated layer 33 transfers yellow printing ink onto the printing paper P placed in a corresponding position via the stencil plate A, the ink impregnated region 33*b* of the impregnated layer 33 transfers magenta printing ink onto the printing paper P placed in a corresponding position via the stencil plate B, and the ink impregnated region 33*c* of the impregnated layer 33 transfers cyan printing ink onto the printing paper P placed in a corresponding position via the stencil plate C so that the stencil printing of each of the colors can be effected in a sequential manner.

When a single cycle of such a stencil printing process is completed, the press plate member 31 is lowered by the vertical actuator 35 with the result that the printing paper P is moved away from the stencil master plate sheet S.

Then, the printing paper P is conveyed in the primary scanning direction by a distance corresponding to the pitch of the stencil master plates A, B and C in the primary scanning direction by means of the paper feed rollers 39. The feeding distance of the printing paper P in the primary scanning direction is monitored by the rotary encoder 42 which detects the rotation of the motor 41, and the feeding of the printing paper P by the prescribed distance is accurately carried out by the feedback control of the rotation of the paper feed rollers 39 based on the amount of rotation of the motor 41 detected by the rotary encoder 42.

When the printing paper is conveyed in the primary feeding direction by the distance corresponding to the pitch of the stencil master plates A, B and C in the primary scanning direction, the print image region produced by using magenta printing ink is placed immediately under the ink impregnated region 33*a* impregnated with yellow printing ink while the print image region produced by using cyan printing ink is placed immediately under the ink impregnated region 33*b* impregnated with magenta printing ink. By lifting the press plate member 31 with the vertical actuator 35 in this condition, the upper surfaces of the stencil master plates A, B and C are again pushed against the ink pad member 29.

As a result, the ink impregnated region 33*a* of the impregnated layer 33 transfers yellow printing ink onto the corresponding part of the printing paper P via the stencil master plate A, the ink impregnated region 33*b* of the impregnated layer 33 transfers magenta printing ink onto the corresponding part of the printing paper P via the stencil master plate B, and the ink impregnated region 33*c* of the impregnated layer 33 transfers cyan printing ink onto the corresponding part of the printing paper P via the stencil master plate C, so that the stencil printing of each of the colors can be accomplished.

By repeating the above described process, it is possible to superimpose a printed image produced by yellow printing ink, a printed image produced by magenta printing ink, and a printed image produced by cyan printing ink on a same part of the printing paper P so that a full color stencil printing may be accomplished as a result.

By conveying the printing paper P in the primary scanning direction by the pitch of the stencil master plates A, B and C each time a single stencil printing process is completed, the printing paper P on which the intended printing process has been carried out is fed out sideways from underneath the stencil master plate sheet S to a position located immediately below the heater 45. The printing ink forming the printed image on the printing paper p is dried by this heater 45. Then, the printing paper P is conveyed by a prescribed distance by the paper feed rollers 39, and the printing paper P is cut by the cutter 47 to separate the printed part of the printing paper P from the rest of the printing paper P.

Figure 5:
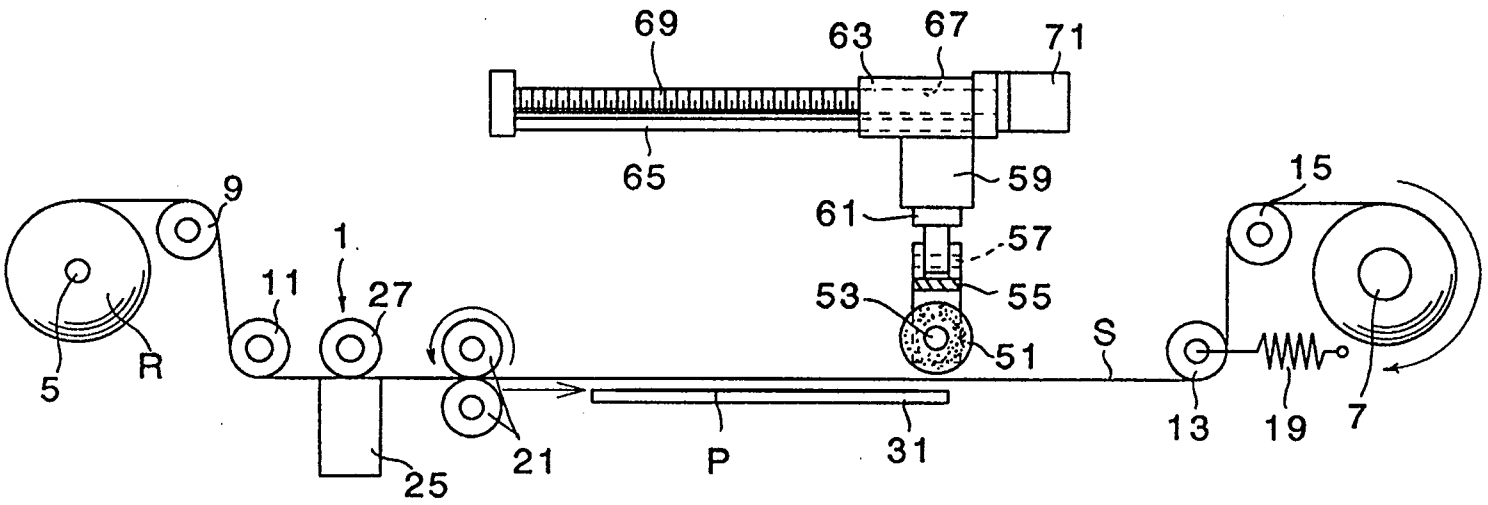
FIG. 5 is a side view showing a second embodiment of the plate making printing device according to the present invention when making a printing plate.
Figure 6:
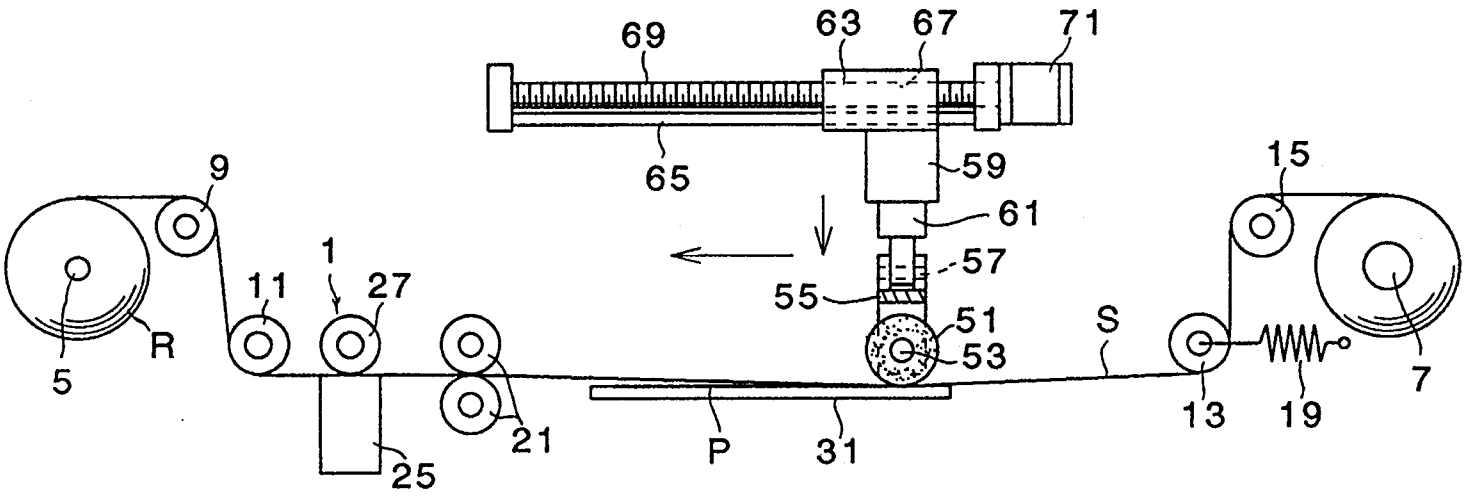
FIG. 6 is a side view showing the second embodiment of the plate making printing device according to the present invention when carrying out a stencil printing.
Figure 7:
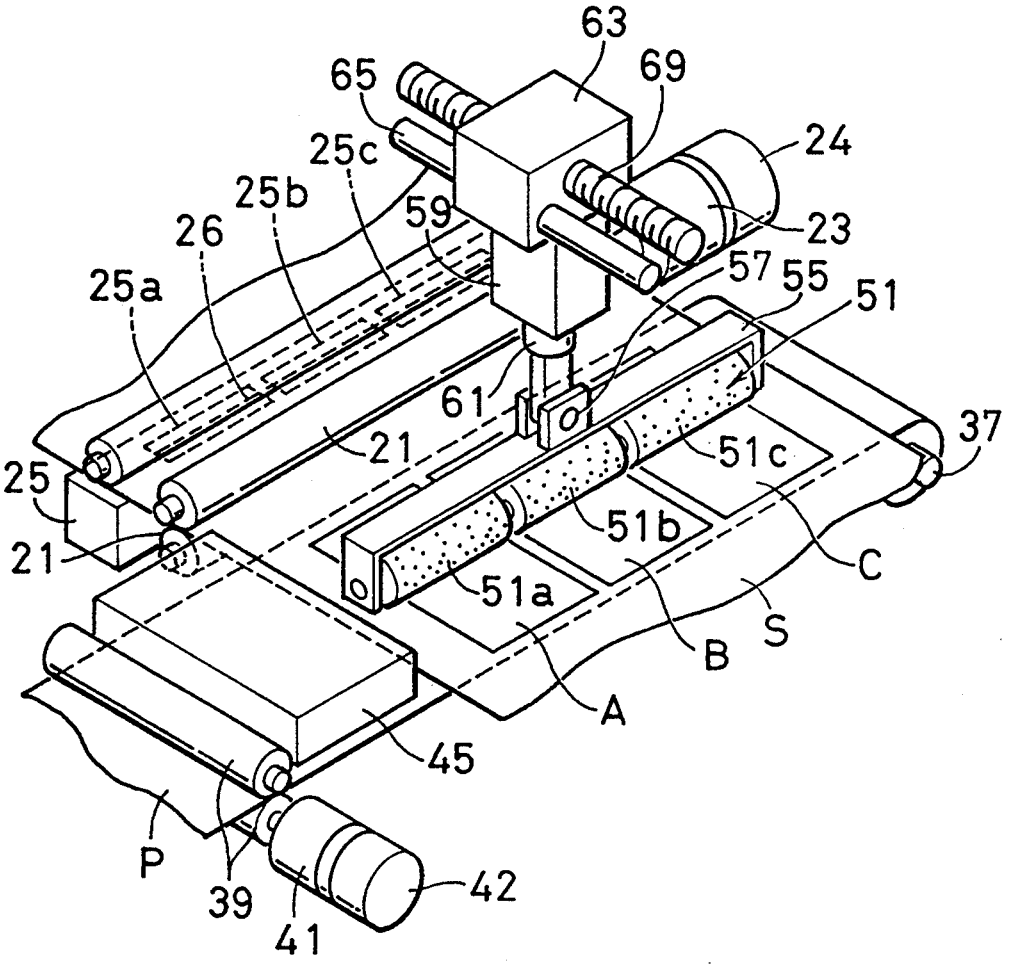
FIG. 7 is a perspective view showing an essential part of the second embodiment of the plate making printing device according to the present invention.

FIGS. 5 through 7 show another embodiment of the master plate making printing device according to the present invention. In FIGS. 5 through 7, the parts corresponding to those in FIGS. 1 through 4 are denoted with like numerals. In this embodiment, the stencil printing is carried out by using an ink roller 51 instead of the ink pad member 29. The ink roller 51 is rotatably supported by a yoke-shaped bracket 55 by way of a roller support shaft 53 which extends in the primary scanning direction of the stencil master plate sheet S. The bracket 55 is pivotably coupled to a plunger 61 of a vertical actuator 59 via a pivot shaft 57.

The vertical actuator 59 is supported by a slider 63 which is slidably engaged with a guide bar 65 extending horizontally above the stencil master plate sheet S in the primary scanning direction so as to be slidable in either direction along the primary scanning direction above the stencil master plate sheet S guided by a guide bar 65.

The slider 63 is formed with a feed nut 67 which threads with a feed screw 69 extending in parallel with the guide bar 65 so that the slider 63 may be moved in either direction along the primary scanning direction with respect to the stencil master plate sheet S as the feed nut 69 is rotatively driven by a motor 71.

The vertical actuator 59 can move the ink roller 51 vertically between an upper position in which the ink roller 51 is spaced away from the upper surface of the stencil master plate sheet S as illustrated in FIG. 5 and a lower position in which the ink roller 51 is pushed against the upper surface of the stencil master plate sheet S as illustrated in FIG. 6.

The ink roller 51 is made of material which can retain printing ink by being impregnated with it, and is separated into three ink impregnated regions 51*a*, 51*b* and 51*c* (refer to FIG. 7) arranged in a single row in the primary scanning direction so as to correspond to the plate making regions 25*a*, 25*b* and 25*c* of the thermal head 25. Thus, in this case also, for full color printing, the ink impregnated region 51*a* may be impregnated with yellow printing ink for retaining it, the ink impregnated region 51*b* may be impregnated with magenta printing ink for retaining it, and the ink impregnated region 51*c* may be impregnated with cyan printing ink for retaining it.

The press plate member 31 is fixed at a position displaced from the lower surface of the stencil master plate S as illustrated, and the printing paper P extends laterally across the stencil master plate sheet S above the press plate member 31 in a similar fashion as in the previous embodiment.

In this embodiment, the process of plate making is carried out by the thermal head 25 in a similar fashion as in the previous embodiment, and stencil master plates A, B and C are formed in three locations of the stencil master plate sheet S arranged along the primary scanning direction. In this case also, the plate making signals supplied to the plate making groups 25*a*, 25*b* and 25*c* may consist of signals produced by the process of color separation for the print images of yellow, magenta and cyan for full color printing, and the plate making groups 25*a*, 25*b* and 25*c* may make the stencil master plates A, B and C for yellow, magenta and cyan print images, respectively.

When the process of plate making is completed, the stencil master plate sheet S is fed in the secondary scanning direction by the stencil master plate sheet feeding rollers and the winding shaft 7 until the stencil master plates A, B and C are placed in the stencil printing positions located immediately above the press plate member 31. When the process of stencil printing is completed, the bracket member 55 is lowered by the vertical actuator 59 along with the ink roller 51, thereby causing the ink roller 51 to push the stencil master plate sheet S against the press plate member 31, and the stencil master plate sheet S to be pushed onto the printing paper P against the press plate member 31.

In this condition, the feed screw 69 is rotatively driven by the motor 71 so that the slider 63 may be moved from a stroke end on the left hand side of the drawing to a stroke end on the right hand side of the drawing, and the ink roller 51 may be caused to roll over the stencil master plate sheet S while pressing the stencil master plate sheet S against the press plate member 31 as illustrated in FIG. 6. As a result, the ink impregnated regions 51*a*, 51*b* and 51*c* are made to supply the ink of the corresponding colors to the stencil master plates A, B and C, respectively, with the final result that stencil printing of the respective colors is carried out on the printing paper P placed on the press plate member 31 by the respective stencil master plates A, B and C.

When the slider 63 has reached the stroke end on the right hand side of the drawing, and a single cycle of stencil printing is completed, a bracket member 55 is lifted by the vertical actuator 59, thereby causing the ink roller 51 to be moved away from the stencil master plate sheet S, and the stencil master plate sheet S to be in turn moved away from the printing paper P on the press plate member 31.

In a similar manner as in the previous embodiment, under the feedback control based on the amount of rotation of the motor 41 detected by the rotary encoder 42, the printing paper P is conveyed in the primary scanning direction by the paper feed rollers 39 by a stroke corresponding to the pitch of the stencil master plates A, B and C in the primary scanning direction. As a result, the printed image region produced by using magenta printing ink is placed immediately under the ink impregnated region 33*a* impregnated with yellow printing ink while the printed image region produced by using cyan printing ink is placed immediately under the ink impregnated region 33b impregnated with magenta printing ink.

Upon completion of the conveying of the printing paper described above, the bracket member 55 is again lowered by the vertical actuator 59 along with the ink roller 51, thereby causing the ink roller 51 to push the stencil master plate sheet S against the press plate member 31, and the stencil master plate sheet S to be in turn pressed against the printing paper P placed on the press plate member 31.

The feed screw 69 is reversed in this condition by the motor 71, thereby causing the slider 63 to be moved from the stroke end on the right hand side of the drawing to the stroke end of the left hand side of the drawing. As a result, the ink roller 51 is again made to roll over the stencil master plate sheet S while pressing the stencil master plate sheet against the press plate member 31, and this movement of the ink roller 51 causes the ink impregnated regions 51*a*, 51*b* and 51*c* to supply printing ink of the corresponding colors to the stencil master plates A, B and C so that the stencil printing of the desired colors by the stencil master plates A, B and C may be carried out on the printing paper placed on the press plate member 31.

Thus, according to this embodiment also, by repeating the above described steps, a printed image by the yellow printing ink, a printed image by the magenta printing ink, and a printed image by the cyan printing ink are superimposed on a same region of the printing paper P, and a full color printing is achieved.

In the above described embodiment, the plate making regions 25*a*, 25*b* and 25*c* for making stencil master plates in the stencil master plate sheet S are contained in a single thermal head 25, but the plate making regions 25*a*, 25*b* and 25*c* may be given by separate individual thermal heads. In that case, the positions of the thermal head may be different along the secondary scanning direction, and may be arranged in a step-wise fashion or in a staggered relationship. Even when the positions of the thermal heads are different as seen along the secondary scanning direction, by appropriately electrically controlling the input timing of a plate making signal for each of the thermal heads, the stencil master plates A, B and C can be aligned in a single row extending in the primary scanning direction.

In the above described embodiment, the stencil master plates A, B and C were arranged in the stencil master plate sheet in a row extending in the primary scanning direction, and the printing paper was fed in the lengthwise direction (in the primary scanning direction) of the stencil master plate sheet S to effect the superimposition printing using the stencil master plates 25*a*, 25*b* and 25*c*, but the present invention is not limited by this embodiment. It is also possible to arrange the stencil master plates A, B and C in the stencil master plate sheet S as a row extending in the secondary scanning direction and to feed in the printing paper P in the secondary scanning direction with respect to the stencil master plate sheet S so as to effect the superimposition printing using the stencil master plates A, B and C.

When the stencil master plates A, B and C are to be arranged in the secondary scanning direction of the stencil master plate sheet, the printing paper P may be placed in a fixed condition because the superimposition printing using the stencil master plate sheets A, B and C can be also effected by moving the stencil master plate sheet S with respect to the printing paper P. In this case, since the printing paper P may be fixed, a superimposition printing of printing paper in the form of cut sheets can be readily accomplished.

Figure 8:
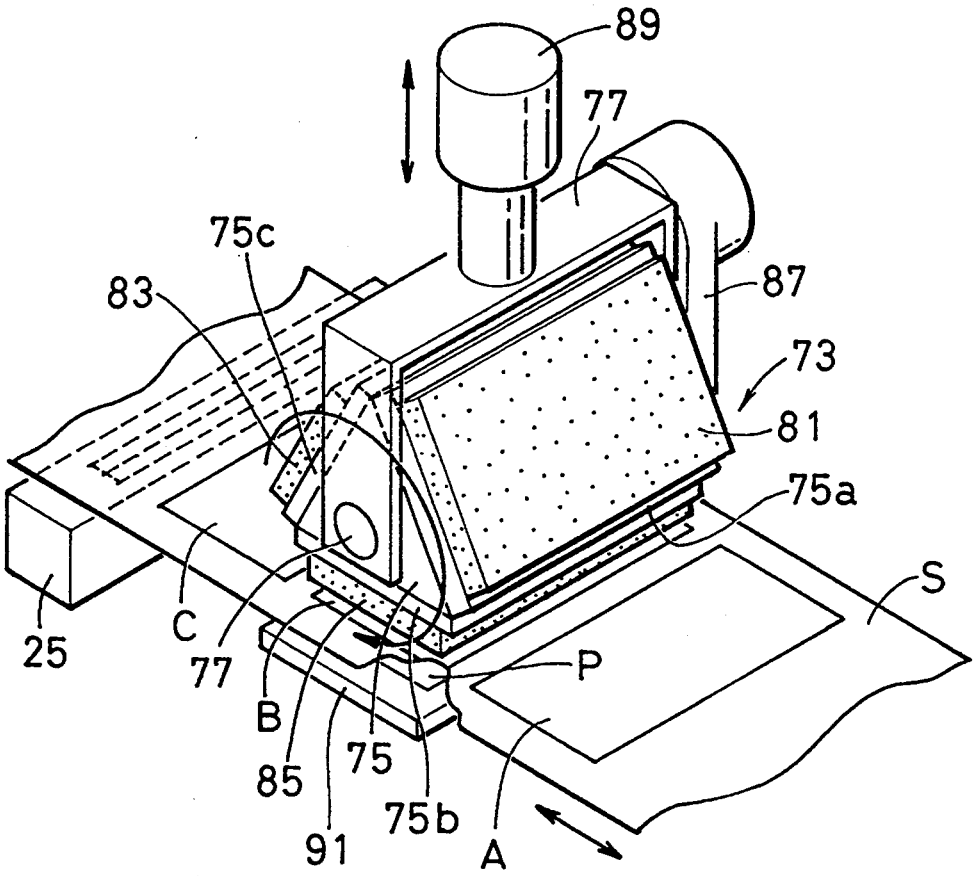
FIG. 8 is a perspective view showing an essential part of a third embodiment of the plate making printing device according to the present invention.

FIG. 8 shows an embodiment of the plate making printing device in which the stencil master plates A, B and C are formed in the stencil master plate sheet S so as to form a row extending in the secondary scanning direction. According to this embodiment, the thermal head 25 is adapted to form the stencil master plates A, B and C in the stencil master plate sheet S so as to extend in the primary scanning direction and to be spaced from each other according to a pre-defined positional relationship by electrically controlling the input timing of the plate making signals for forming the stencil master plates A, B and C. In this case, the length of the thermal head 25 in the primary scanning direction may be such as to correspond to the length of each stencil master plate in the primary scanning direction.

An ink pad device 73 is placed above the stencil master plate sheet S. The ink pad device 73 comprises a pad mount member 75 in the shape of a rod having a triangular cross section which is rotatably supported by a bracket member 77 via a pivot shaft 79. The three sides *75a*, *75b* and *75c* of the pad mount member 75 are provided with ink pads 81, 83 and 85 each consisting of an ink impregnated layer. The ink pad 81 is impregnated with yellow printing ink, the ink pad 83 is impregnated with magenta printing ink, and the ink pad 85 is impregnated with cyan printing ink.

The pad mount member 75 can be indexed around the pivot shaft 79 by 120 degrees by a index drive device 87 incorporated with a motor so that any selected one of the three ink pads 81, 83 and 85 may be faced to the upper surface of the stencil master plate sheet S.

The bracket member 77 is supported by a vertical actuator 89 so as to be vertically moveable, and can move the pad mount member 75 between an upper position in which the pad mount member 75 is lifted from the upper surface of the stencil master plate sheet S and a lower position in which one of the ink pads 81, 83 and 85 is pressed against the stencil master plate sheet S.

A paper table 91 is fixedly positioned in a position opposing the ink pad device 73 with the stencil master plate sheet S interposed therebetween, and can removable hold a pre-cut sheet of paper on a table surface slightly removed from the lower surface of the stencil master plate sheet S.

In this embodiment, by placing a sheet of cut paper P on the table surface of the paper table 91, and sequentially moving the stencil master plate sheet S carrying the stencil master plates A, B and C, a selected one of the stencil master plates can be placed immediately below the ink pad device 73.

By indexing the pad mount member 75 by 120 degrees with the index drive device 87 around the pivot shaft 79 when the bracket member 77 is at its upper position, one of the ink pads 81, 83 and 85 is made to face the upper surface of the stencil master plate sheet S. By lowering the bracket member 77 with the vertical actuator 89 in this condition, and pushing the ink pad 81, 83 or 85 facing the upper surface of the stencil master plate sheet S against the upper surface of the stencil master plate sheet S, the stencil master plate sheet S is brought into contact with the cut sheet paper P placed on the table surface of the paper table 91, and a stencil printing is carried out by one of the stencil master plates A, B and C by the corresponding ink pad 81, 83 or 85 supplying printing ink to the cut sheet paper P placed on the table surface of the paper table 91 via the corresponding stencil master plate A, B or C.

In this case, by moving the stencil master plate sheet S in the secondary scanning direction, and changing the ink pad 81, 83 or 85 facing the upper surface of the stencil master plate sheet S through the indexing movement of the pad mount member by 120 degrees in a corresponding manner, a superimposition printing of different colors or a multicolor printing can be carried out on the cut sheet paper P placed on the table surface of the paper table 91.

Figure 9:
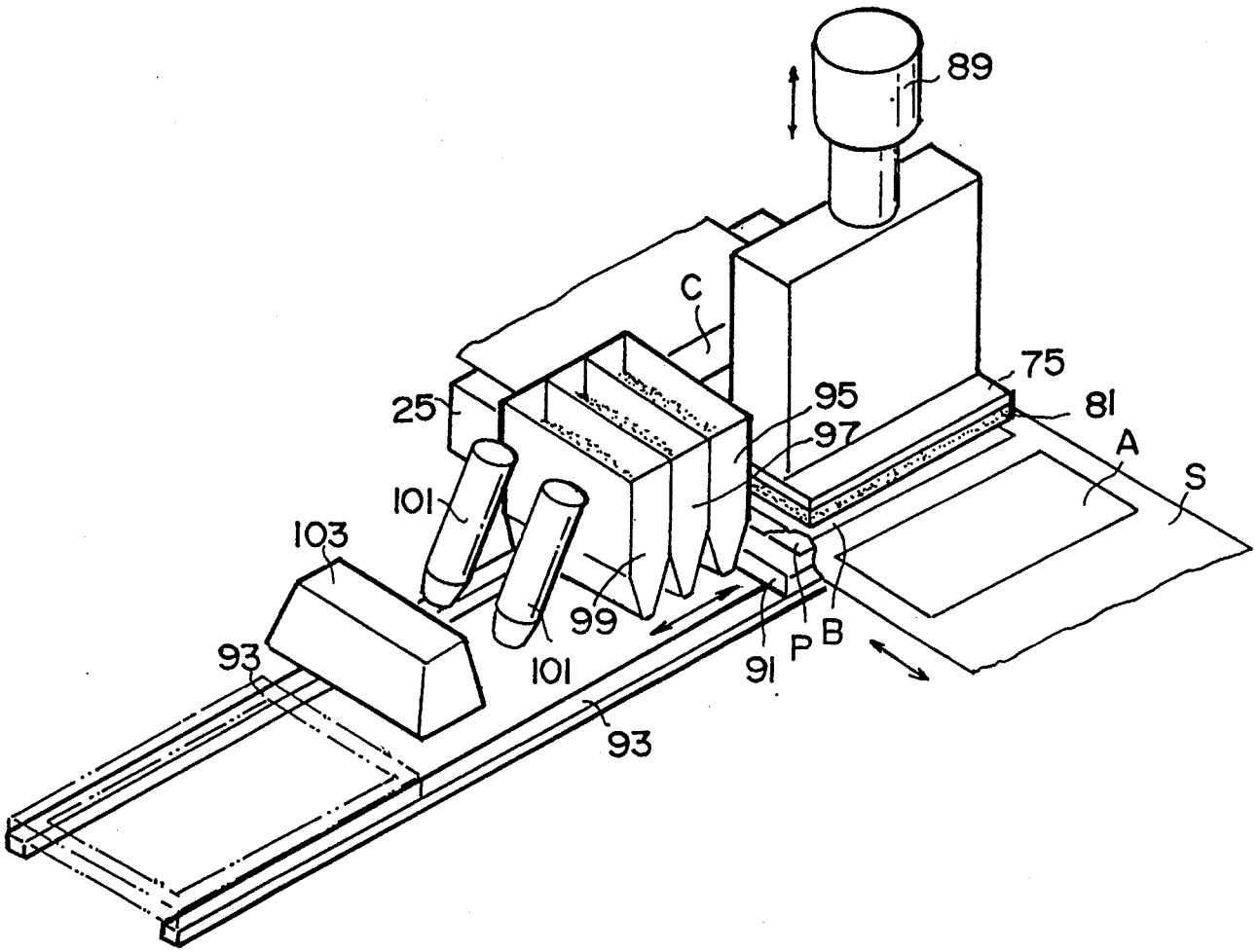
FIG. 9 is a perspective view showing an essential part of a fourth embodiment of the plate making printing device according to the present invention.

FIG. 9 shows an embodiment of the plate making printing device according to the present invention which is applied to a stencil printing device based on the principle of forming visible images by using powder ink consisting of colored fine particles. In FIG. 9, the parts corresponding to those in FIG. 8 are denoted with like numerals. In this embodiment, a pad mount member 75 is vertically moved by a vertical actuator 89 in a region located above the stencil master plate sheet S, and is provided with a single ink pad 81 facing the upper surface of the stencil master plate sheet S. The ink pad 81 retains or is impregnated with a powder ink adhering agent such as transparent printing ink or a liquid bonding agent.

A paper table 91 is placed below the stencil master plate sheet S and is guided by a linear guide member 93 between a powder ink adhering agent applying position in which the paper table 91 opposes the pad mount member 75 with the stencil master plate sheet S placed therebetween and a powder ink fixing position in which the paper table 91 is moved sideways from underneath the stencil master plate sheet S by moving perpendicularly to the direction in which the stencil master plates A, B and C are arranged.

Above a part of the path located between the powder ink adhering agent applying position and the powder ink fixing position are located powder ink spraying hoppers 95, 97 and 99 which respectively contain powder inks of yellow, magenta and cyan colors, in that order as seen from the powder ink adhering agent applying position, for spraying the ink of the corresponding colors on printing paper P (cut sheet paper) placed on the paper table 91, an air jet nozzle 101 for removing excessive powder ink from the upper surface of the printing paper P, and a thermal fixing unit 103, in that order.

In this embodiment, by lowering the pad mount member 75 with the vertical actuator 89, and pressing the ink pad 81 facing the upper surface of the stencil master plate sheet S against the same, the stencil master plate sheet S is brought into contact with the printing paper P placed on the paper table 91, and the powder ink adhering agent impregnated in the ink pad 81 is transferred onto the printing paper P via the perforations of the stencil master plate A of the stencil master plate sheet S, thereby forming an image on the printing paper P with the powder ink adhering agent.

Then, during the process of moving the paper table 91 guided by the linear guide member 93, the yellow powder ink is sprayed onto the printing paper P placed on the paper table 91, and forms a visible image by adhering to the powder ink adhering agent deposited on the printing paper in a pattern corresponding to the visible image. Air is then sprayed onto the printing paper P from the air jet nozzle 101 to remove excessive powder ink from the upper surface of the printing paper P. As the printing paper P placed on the paper table 91 passes underneath the thermal fixing unit 103, the visible image formed by the yellow powder ink adhering to the image pattern formed by the powder ink adhering agent on the printing paper P is thermally fixed.

After this process of thermal fixing, the paper table 91 is returned to the powder ink adhering agent applying position, and through the displacement of the thermal stencil master plate S in the secondary scanning direction the stencil master plate located immediately below the ink pad device 73 is changed from the stencil master plate A to the stencil master plate B. By carrying out a similar stencil printing operation with the stencil master plate B as with the stencil master plate A, a visible image by the magenta powder ink is formed on the same printing paper. Thereafter, the stencil master plate is changed from the stencil master plate B to the stencil master plate C, and a visible image by the cyan powder ink is formed on the same printing paper by carrying out a similar process of stencil printing. A multicolor printing can be thus accomplished.

Therefore, according to this embodiment also, the stencil master plates A, B and C are formed on a same stencil master plate sheet S, and a superimposition printing similar to those of the previous embodiments is accomplished.

The removable of excessive powder ink from the upper surface of the printing paper P can be accomplished not only by blowing it away with air but also by using suction, applying vibration to the printing paper or allowing the powder ink to fall off by turning the printing paper upside down.

Figure 10:
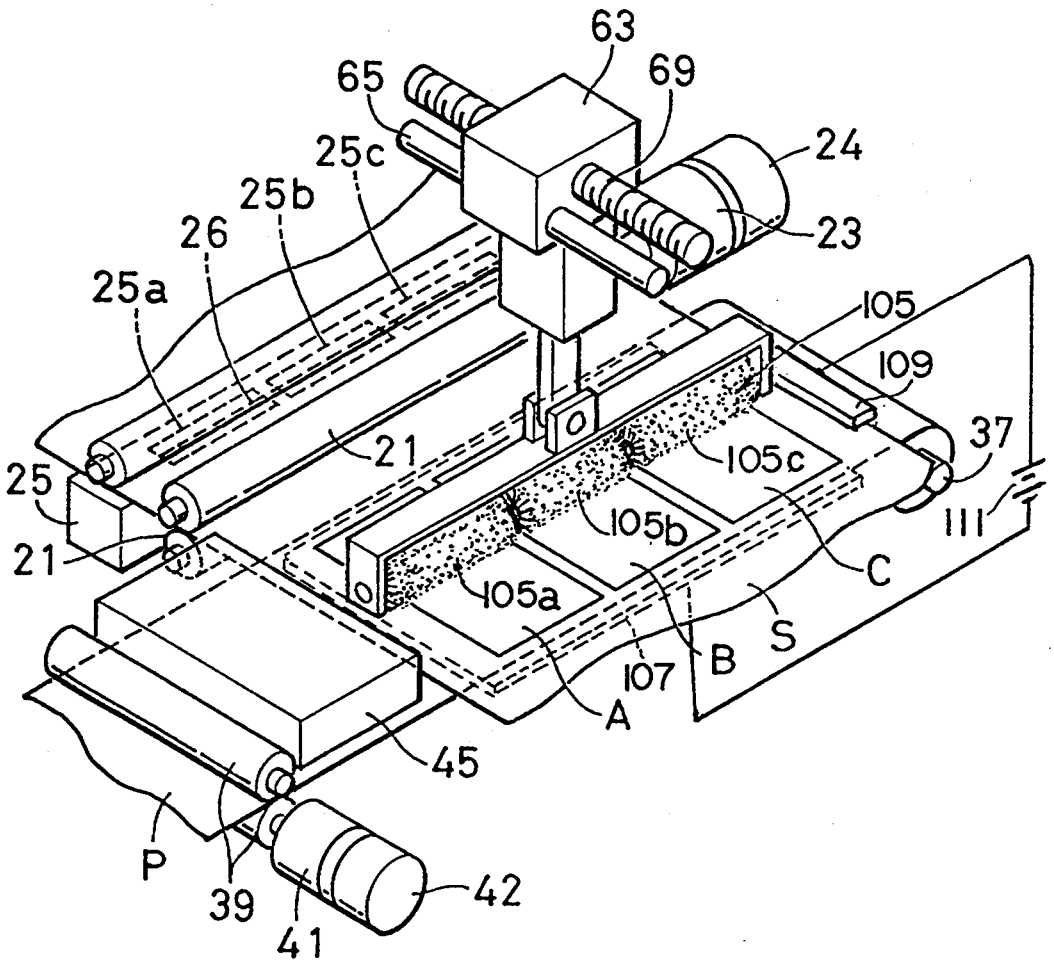
FIG. 10 is a perspective view showing an essential part of a fifth embodiment of the plate making printing device according to the present invention.

FIG. 10 shows an embodiment of the plate making printing device according to the present invention which is applied to a stencil printing device based on the principle of electrographically forming visible images. In FIG. 10, the parts corresponding to those in FIG. 7 are denoted with like numerals. In this embodiment, a toner brush 105 which may consist of a magnetic brush, instead of the ink roller 51, is suspended from a slider 63 so as to be slidable over the upper surface of a stencil master plate sheet S. The toner brush 105 is separated into three toner retaining regions 105*a*, 105*b* and 105*c* along the primary scanning direction so as to correspond to the plate making groups 25*a*, 25*b* and 25*c* of the thermal head 25. The toner retaining region 105*a* retains yellow toner, the toner retaining region 105*b* retains magenta toner, and the toner retaining region 105*c* retains cyan toner.

A counter electrode plate 107, instead of the press plate member 31, is placed under the printing paper P so as to oppose the toner brush 105 with the stencil master plate sheet S interposed therebetween, and the printing paper P is disposed so as to slide over the counter electrode plate 107.

The stencil master plate sheet S used in this embodiment consists of a laminated assembly of a thermoplastic resin film and an electroconductive porous support sheet, and the toner brush 105 slides over the electroconductive porous support sheet which faces up. With regard to this stencil master plate sheet S also, the thermoplastic film facing down is thermally perforated so as to form desired images.

An electrode plate 109 slides over the electroconductive porous support sheet of the stencil master plate sheet S in an electroconductive relationship, and a prescribed voltage is applied across the electrode plate 109 and the counter electrode plate 107 from a power source 111.

In this case, the positive electrode of the power source 111 is electrically connected to the electrode plate 109 while the negative electrode of the power source 111 is electrically connected to the counter electrode plate 107 so that the electrically neutral toner retained by the toner retaining regions 105*a*, 105*b* and 105*c* becomes positively charged by losing negative electric charges by contacting the electroconductive porous support sheet of the stencil master plate sheet S, and is transferred onto the printing paper P placed on the counter electrode plate 107 via the perforations of the thermoplastic resin film of the stencil master plate sheet S according to the electric field formed between the electroconductive porous support sheet of the stencil master plate sheet S and the counter electrode plate 107, thereby forming a toner image on the printing paper P. This toner image is thermally fixed by the heater 45 as the printing paper P is moved in the primary scanning direction with respect to the stencil master plate A, B and C.

In this embodiment also, as was the case with the embodiment illustrated in FIG. 7, the stencil master plates A, B and C are formed on a same stencil master plate sheet S, and a superimposition printing is carried out in a similar manner as in the previous embodiments, however according to the principle of electrographic stencil printing, by moving the stencil master plate sheet S in the primary scanning direction by a distance corresponding to the pitch of the stencil master plates A, B and C in the primary scanning direction every time a stencil printing process is completed.

Figure 11:
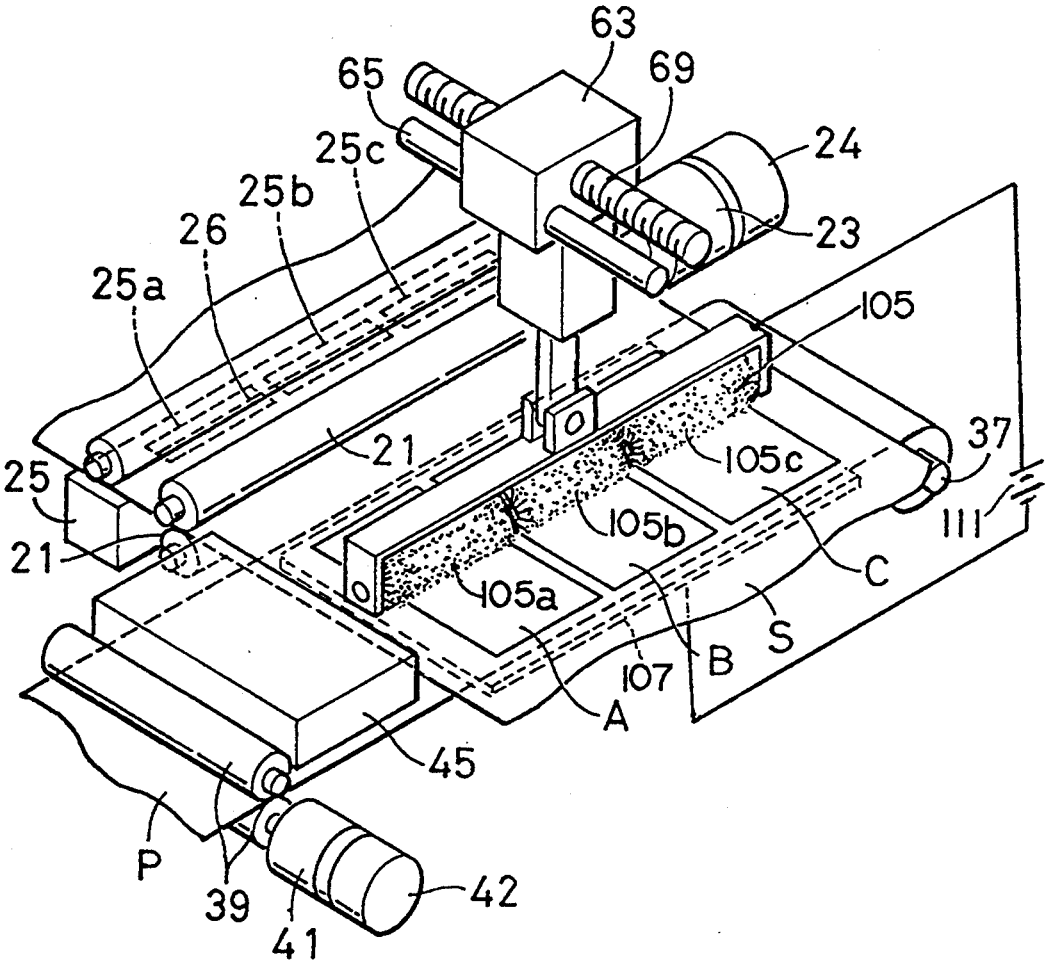
FIG. 11 is a perspective view showing an essential part of a sixth embodiment of the plate making printing device according to the present invention.

The electric field for the electrographic stencil printing can be also formed by applying a prescribed voltage across the toner brush 105 supported by an insulator and the counter electrode plate 107 with the power source 111 as illustrated in FIG. 11.

In this case, the stencil master plate sheet S may consist of a normal stencil master plate sheet S consisting of a laminated assembly of a thermoplastic resin film and a normal porous support sheet instead of an electroconductive porous support sheet.

Because the stencil printing carried out by these electrographic stencil printing processes does not involve any contact or pressure between the printing paper P and the stencil master plate sheet S, one advantage is that, during the process of superimposition printing on a same region of the printing paper as is necessitated by the present invention, the preceding image would not be damaged by the subsequent images.

In addition to the electrographic stencil printing processes described above, the electrographic stencil printing process disclosed in Japanese patent publication for opposition purpose (kokoku) No. 48-18342 can be also applied to the present invention. The content of this prior patent publication is hereby incorporated in the present application by reference.

In the above described embodiments, the full color printing was carried out by using the three colors consisting of cyan, magenta and yellow, but it may also involve four colors including the black color in addition to the three colors. In this case, for the printing process using the black printing ink, the thermal head 25 is required to form four stencil master plates in a single master plate sheet S.

The superimposition printing process using a plurality of stencil master plates described above may be used not only for a multicolor printing but also for a monochromatic or multicolor printing combining an image of a photographic mode and a character image.

As described above, according to the stencil printing method or the plate making printing device of the present invention, since the stencil master plates are formed in a plurality of parts of a single stencil master plate sheet with a pre-defined positional relationship, and the relative positional relationship between the stencil master plates is definitely determined by the stencil master plate sheet serving as a common carrier for the stencil master plates, even when the stencil master plate sheet is moved from a plate making position to a stencil printing position, the relative positional relationship between the stencil master plates in the stencil master plate sheet is maintained. Therefore, once the position of one of the stencil master plates is determined, the positions of the remaining stencil master plates can be automatically and accurately determined by the first mentioned stencil master plate serving as a reference. Because the accuracy of superimposition printing can be determined by the positioning of the print object relative to the stencil master plates, the present invention allows a highly accurate superimposition printing to be accomplished in a simple manner without requiring any complicated positioning work.

Although the present invention has been described in terms of specific embodiments thereof, it is possible to modify and alter details thereof without departing from the spirit of the present invention.

What we claim is:

1. A stencil printing method, comprising the steps of:

making a plurality of stencil master plates in different regions of a stencil master plate sheet in a predefined mutual positional relationship by arranging said stencil master plates in a single row extending in a first direction;

feeding said stencil master plate sheet to a printing position by moving said stencil master plate in a direction perpendicular to the first direction; and printing on a same region of a print object by using said stencil master plates in a mutually superimposed relationship.

2. The stencil printing method of claim 1, further comprising the step of moving said print object while keeping said master plate sheet stationary in order to cause said prints to be made in said same region by said stencil master plates in a mutually superimposed relationship.

3. The stencil printing method of claim 1, further comprising the steps of using a plurality of inks having different colors corresponding to said plurality of stencil master plates.

4. The stencil printing method of claim 1, further comprising the step of unrolling said stencil master plate sheet from a winding roller in order to feed said master stencil plate to said printing position.

* * * * *